US009000983B2

(12) United States Patent
Kim et al.

(10) Patent No.: US 9,000,983 B2
(45) Date of Patent: Apr. 7, 2015

(54) PLANAR INVERTED F ANTENNA

(75) Inventors: Seon-Jun Kim, Suwon-si (KR); Dong-Beom Seol, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 352 days.

(21) Appl. No.: 12/218,514

(22) Filed: Jul. 16, 2008

(65) Prior Publication Data

US 2009/0021432 A1 Jan. 22, 2009

(30) Foreign Application Priority Data

Jul. 16, 2007 (KR) ..... 10-2007-0071318

(51) Int. Cl.
*H01Q 9/04* (2006.01)

(52) U.S. Cl.
CPC ..... *H01Q 9/0421* (2013.01)

(58) Field of Classification Search
USPC ..... 343/702, 700 MS
See application file for complete search history.

(56) References Cited

U.S. PATENT DOCUMENTS 4,907,006 A * 3/1990 Nishikawa et al. .... 343/700 MS
6,650,294 B2 * 11/2003 Ying et al. ..... 343/700 MS
6,897,814 B2 5/2005 Iwai et al.
7,486,245 B2 2/2009 Park et al.
7,848,771 B2 12/2010 Boyle
2005/0140554 A1 * 6/2005 Wang et al. ..... 343/702
2006/0066488 A1 * 3/2006 Zhinong ..... 343/702
2008/0001829 A1 * 1/2008 Rahola et al. ..... 343/702
2008/0055160 A1 * 3/2008 Kim et al. ..... 343/700 MS

FOREIGN PATENT DOCUMENTS

KR 1020020040595 A 5/2002
KR 1020060013399 A 2/2006
KR 1020060035999 A 4/2006
KR 1020070064196 A 6/2007

OTHER PUBLICATIONS

Notice of Decision to Grant Patent dated Aug. 27, 2013 in connection with Korean Application No. 10-2007-0071318; 4 pages.

* cited by examiner

*Primary Examiner* — Trinh Dinh

(57) ABSTRACT

Provided is a planar inverted F antenna including a ground surface having a finite plane and formed of a conductive material, an antenna body at a certain distance from the ground surface and transmitting and receiving radio waves, a feed line for electrically connecting the ground surface and the antenna body, a ground pin for grounding the antenna body to the ground surface, and at least one auxiliary plate disposed between the antenna body and the ground surface. Therefore, it is possible to readily overcome design restrictions of the antenna in keeping with the slimming and miniaturization of mobile communication terminals by installing the auxiliary plate between the ground surface and the antenna body.

20 Claims, 10 Drawing Sheets

PLANAR INVERTED F ANTENNA

CROSS-REFERENCE TO RELATED APPLICATION(S) AND CLAIM OF PRIORITY

The present application makes reference to and claims all benefits accruing under 35 U.S.C. §119 from an application for PLANER INVERTED F ANTENNA earlier filed in the Korean Intellectual Property Office on 16 Jul. 2007, and there duly assigned Serial No. 2007-71318.

TECHNICAL FIELD OF THE INVENTION

The present invention relates to a planar inverted F antenna, and more particularly, to a planar inverted F antenna capable of improving antenna performance by adding an auxiliary plate between a ground surface and an antenna body.

BACKGROUND OF THE INVENTION

For mobile communication terminal antennas, various models for performing the following properties have been proposed. In order to accomplish high efficiency, low loss, compact and lightweight structure, omni-directionality of radiation pattern, impedance matching for increasing radiation efficiency, packaging technology for design simplification, low cost, human body protection technology from radiation, wide bandwidth, low power consumption, improved technology appropriate to electromagnetic environment, etc., various kinds of antenna technologies have been developed.

Along with the slimming and miniaturization of mobile communication terminals, the size of the antenna has also decreased. At this point, technology capable of minimizing the size of the antenna while still maintaining the same function is one of the most important technologies.

Conventional mobile communication terminal antennas such as monopole antennas, whip antennas, helical antennas, sleeve antennas, inverted F antennas, diversity antennas, micro-strip antennas, chip antennas, twisted loop antennas, EID antennas, N-type antennas, etc., have been developed.

Such antennas may be classified as either internal or external antennas depending on the installation position. External antennas include monopole antennas, whip antennas, helical antennas, sleeve antennas, N-type antennas, chip antennas, FS-FIFI antennas, etc., all of which are installed at the exterior of terminals.

Internal antennas include inverted F antennas, planar inverted F antennas, diversity antennas, micro-strip antennas, twisted loop antennas, EID antennas, etc., all of which are installed in the interior of terminals.

Planar antennas may be classified further as inverted F antennas, planar inverted F antennas, diversity antennas, micro-strip antennas, EID antennas, FS-FIFA antennas, RCDLA antennas, or DTSA antennas, all of which have a planar structure.

In the conventional planar antennas, since the size of the antenna has also decreased with the slimming and miniaturization of mobile communication terminals, it is difficult to minimize the size of the antenna while still maintaining the same function.

SUMMARY OF THE INVENTION

To address the above-discussed deficiencies of the prior art, it is a primary object of the present invention to provide a planar inverted F antenna capable of reducing the size of the antenna and readily tuning the antenna in keeping with the slimming and miniaturization of mobile communication terminals by installing an auxiliary plate between a ground surface and an antenna body.

According to an exemplary embodiment of the present invention, a planar inverted F antenna includes: a ground surface having a finite plane and formed of a conductive material; an antenna body at a certain distance from the ground surface and transmitting and receiving radio waves; a feed line for electrically connecting the ground surface and the antenna body; a ground pin for grounding the antenna body to the ground surface; and at least one auxiliary plate disposed between the antenna body and the ground surface.

According to another exemplary embodiment of the present invention, a planar inverted F antenna includes: a ground surface having a finite plane and formed of a conductive material; an antenna body at a certain distance from the ground surface and transmitting and receiving radio waves; a feed line for electrically connecting the ground surface and the antenna body; a ground pin for grounding the antenna body to the ground surface; and at least one auxiliary plate disposed between the antenna body and the at least one auxiliary plate to be inclined with respect to the ground surface.

According to still another exemplary embodiment of the present invention, a planar inverted F antenna includes: a ground surface having a finite plane and formed of a conductive material; an antenna body at a certain distance from the ground surface and transmitting and receiving radio waves; a feed line for electrically connecting the ground surface and the antenna body; a ground pin for grounding the antenna body to the ground surface; and at least one auxiliary plate disposed between the antenna body and the ground surface, a portion of which is covered by the antenna body, and the other portion of which is exposed.

Here, the auxiliary plate may have a width relatively smaller than, equal to, or relatively larger than that of the antenna body. The auxiliary plate may have a "]" or "T" shape.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the, present disclosure and its advantages, reference is now made to the following description taken in conjunction with the accompanying drawings, in which like reference numerals represent like parts.

DETAILED DESCRIPTION OF THE INVENTION

FIGS. 1 through 20, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged wireless communication systems.

Figure 1:
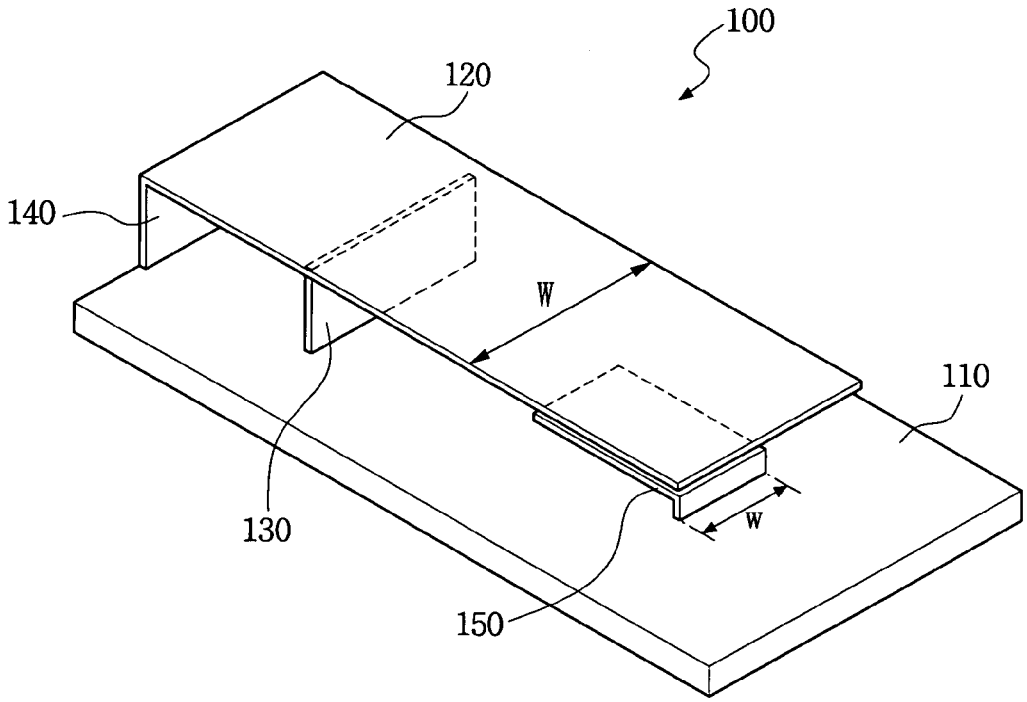
FIG. 1 is a perspective view of a planar inverted F antenna in accordance with a first exemplary embodiment of the present invention.
Figure 2:
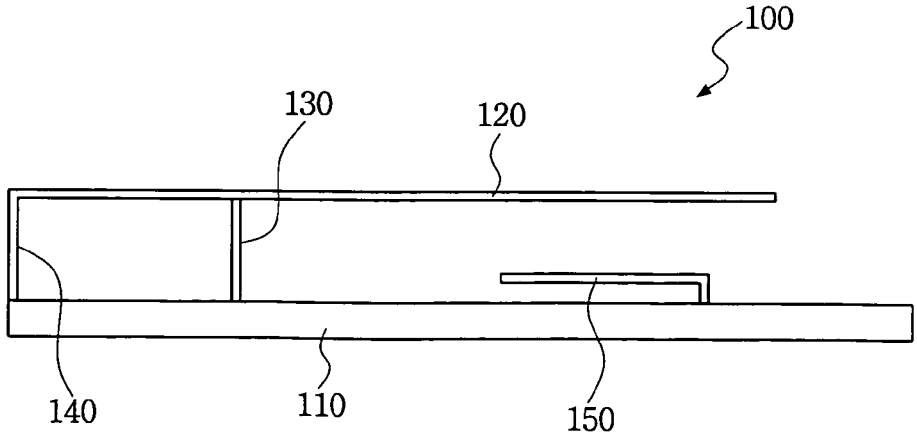
FIG. 2 is a side view of FIG. 1.
Figure 3:
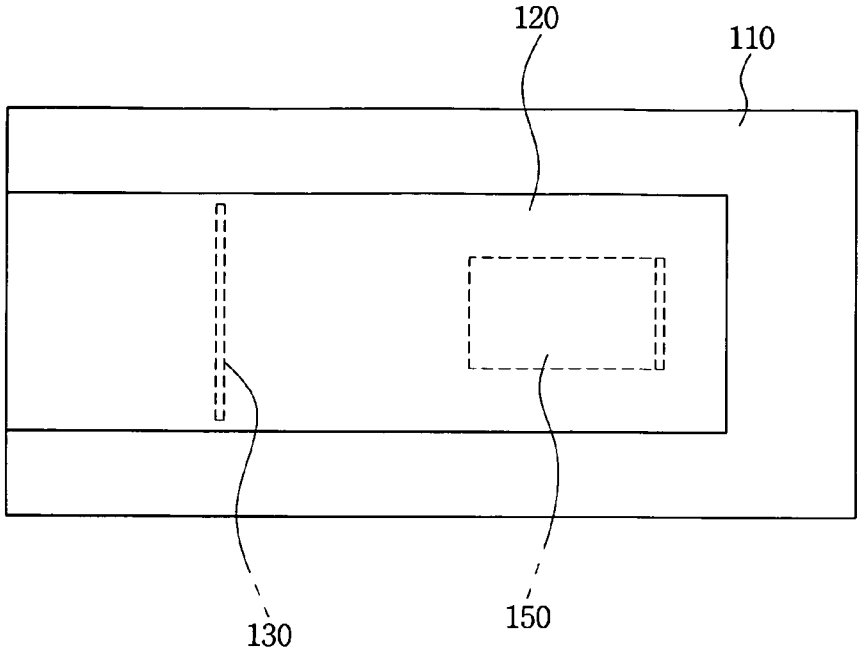
FIG. 3 is a top view of FIG. 1.
Figure 4:
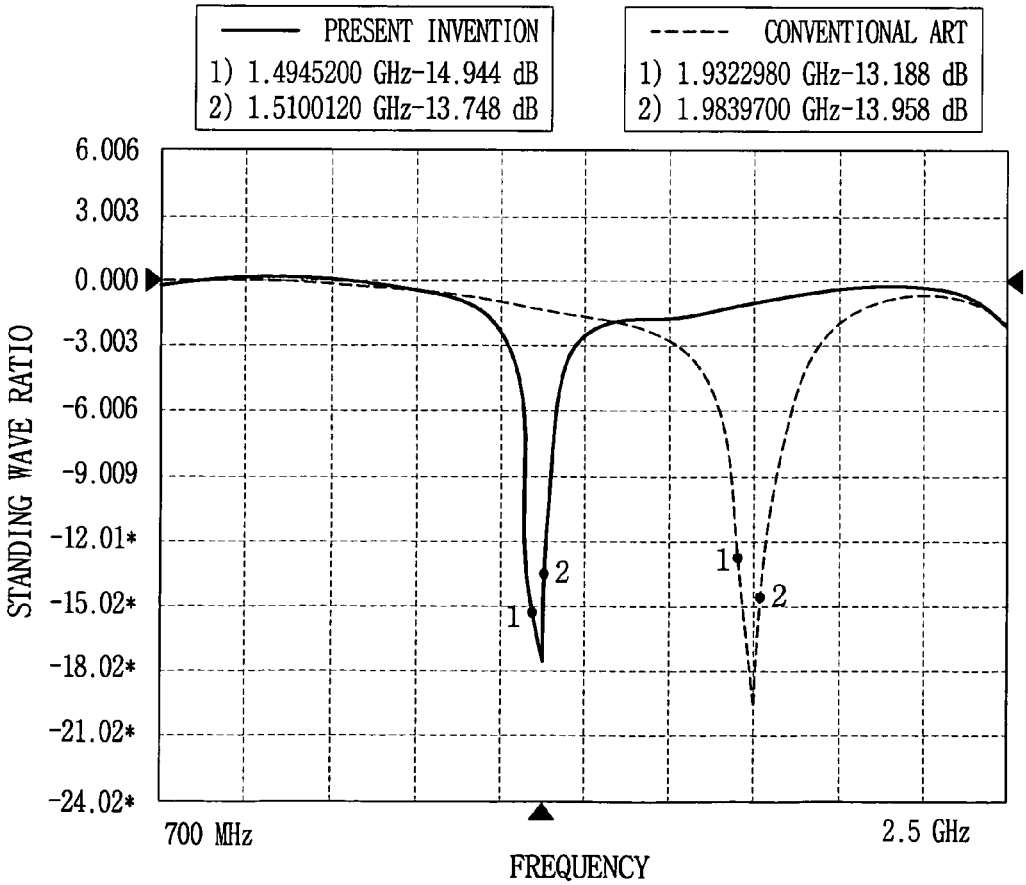
FIG. 4 is a graph showing the performance of the planar inverted F antenna in accordance with the first exemplary embodiment of the present invention.

FIG. 1 is a perspective view of a planar inverted F antenna in accordance with a first exemplary embodiment of the present invention, FIG. 2 is a side view of FIG. 1, FIG. 3 is a top view of FIG. 1, and FIG. 4 is a graph showing the performance of the planar inverted F antenna in accordance with the first exemplary embodiment of the present invention.

Referring to FIGS. 1 to 3, a planar inverted F antenna 100 in accordance with a first exemplary embodiment of the present invention includes a ground surface 110 having a finite plane and formed of a conductive material.

Here, conventionally, the ground surface 110 is a printed circuit board. An antenna body 120 is horizontally installed over the ground surface 110 at a certain distance from the ground surface 110 and transmits/receives radio waves.

A feed line 130 is vertically installed on the ground surface 110 to electrically connect the antenna body 120 to the ground surface 110.

A ground pin 140 is formed at an end of the antenna body 120 to ground the antenna body 120 to the ground surface 110.

An auxiliary plate 150 is installed between the antenna body 120 and the ground surface 110.

Figure 5:
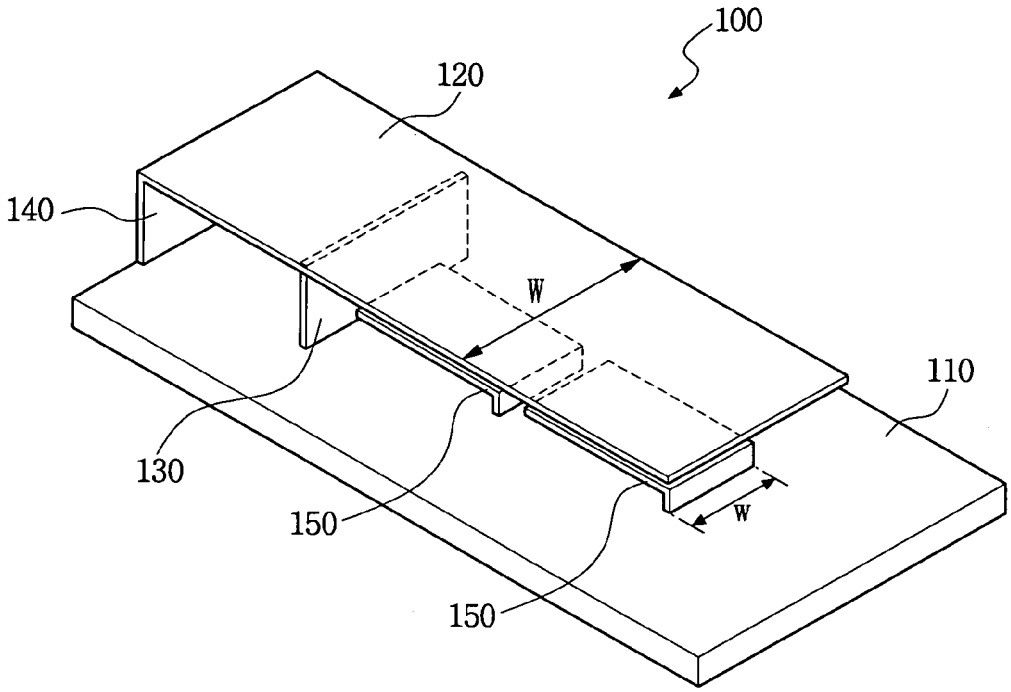
FIG. 5 is a perspective view of a modified example of an auxiliary plate of the planar inverted F antenna in accordance with the first exemplary embodiment of the present invention.

A single auxiliary plate 150 may be installed, two auxiliary plates 150 may be installed as shown in FIG. 5, or, while not shown, three or more auxiliary plates may be installed.

The auxiliary plate 150 may have a width w relatively smaller than that of the antenna body 120.

Hereinafter, operation of the planar inverted F antenna in accordance with a first exemplary embodiment of the present invention will be described.

Because the size of the antenna also is reduced in keeping with the slimming and miniaturization of mobile communication terminals and frequency is inversely proportional to the length of the antenna, design of the antenna is subjected to many restrictions.

The planar inverted F antenna 100 in accordance with the first exemplary embodiment of the present invention can remarkably reduce the total size of the antenna at the same frequency by installing the auxiliary plate 150 between the ground surface 110 and the antenna body 120 in consideration of the above problems.

Therefore, in keeping with the slimming and miniaturization of mobile communication terminals, it is possible to design a smaller antenna.

FIG. 4 is a graph for comparing the performance of a conventional planar inverted F antenna with the performance of the planar inverted F antenna in accordance with the first exemplary embodiment of the present invention.

In the graph of FIG. 4, the X-axis represents frequency, and the Y-axis represents standing wave ratio. A solid line represents an experiment value of the present invention, and a broken line represents an experiment value of the conventional art.

As a result of measuring frequencies of arbitrary points around a standing wave ratio of −15 dB to −12 dB, the frequencies of the conventional art are 1.9322 GHz and 1.9839 GHz, respectively, and the frequencies of the present invention are 1.4945 GHz and 1.5100 GHz, respectively.

Comparing the present invention with the conventional art in this graph, it will be appreciated that the frequency of the present invention is reduced by about 0.4 to 0.5 GHz. Considering the inverse relationship between frequency and antenna size, it will be appreciated that the total size of the antenna can be remarkably reduced when the same frequency is used.

Figure 6:
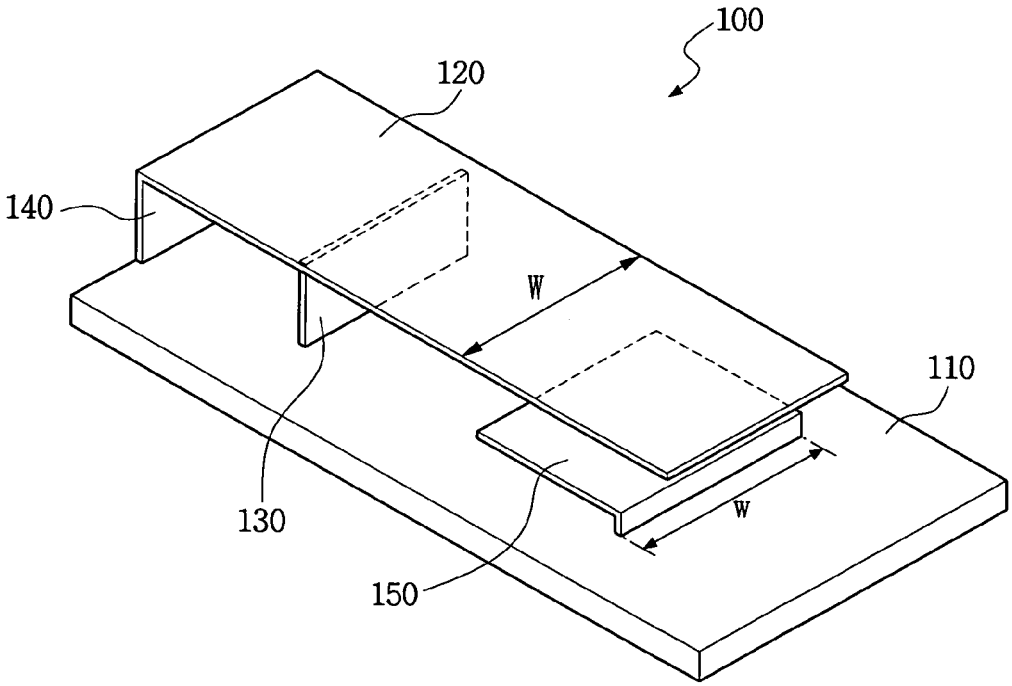
FIG. 6 is a perspective view of another modified example of the auxiliary plate of the planar inverted F antenna in accordance with the first exemplary embodiment of the present invention.
Figure 7:
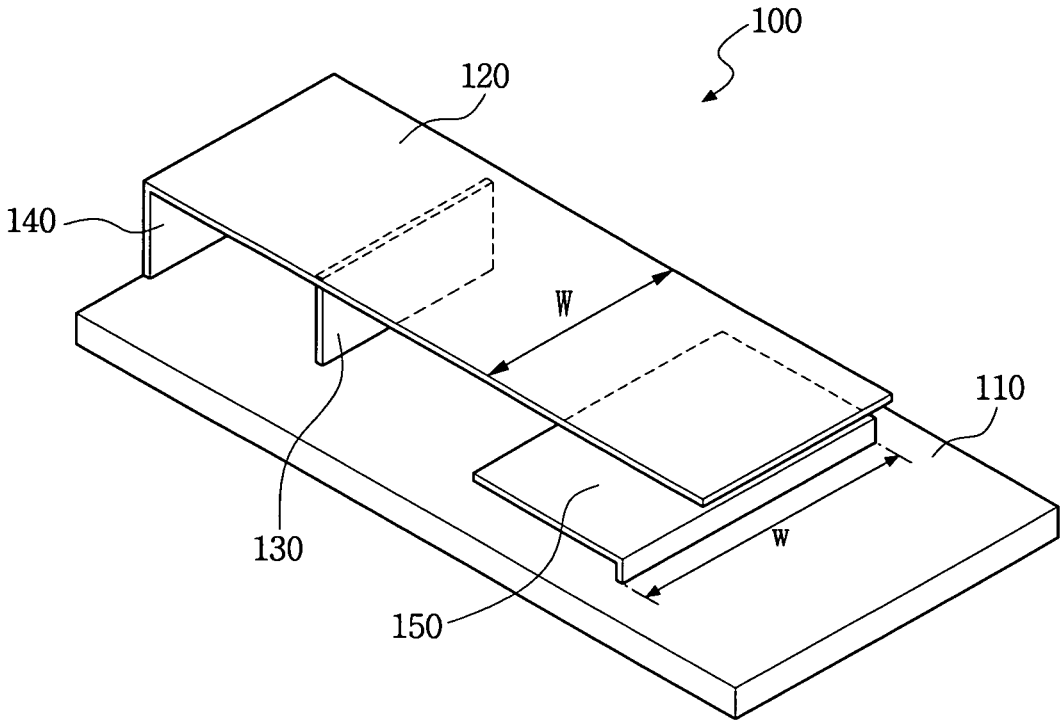
FIG. 7 is a perspective view of still another modified example of the auxiliary plate of the planar inverted F antenna in accordance with the first exemplary embodiment of the present invention.
Figure 8:
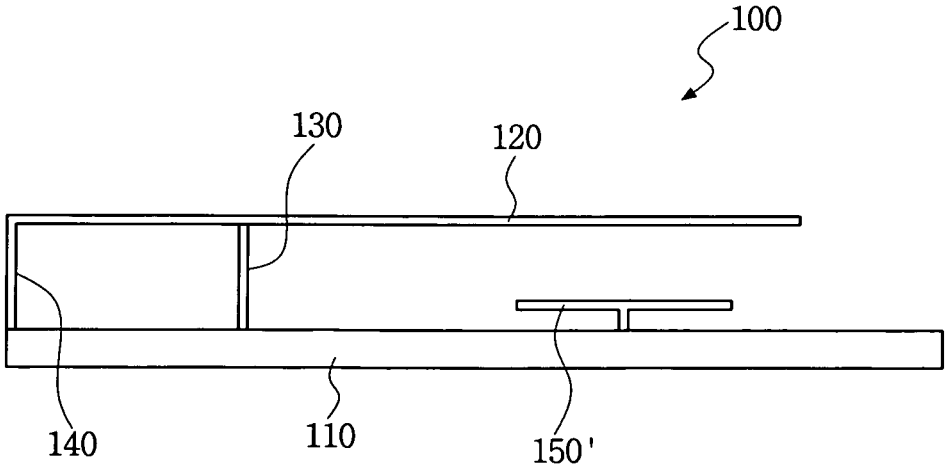
FIG. 8 is a side view of yet another modified example of the auxiliary plate of the planar inverted F antenna in accordance with the first exemplary embodiment of the present invention.

FIG. 6 is a perspective view of another modified example of the auxiliary plate of the planar inverted F antenna in accordance with the first exemplary embodiment of the present invention, FIG. 7 is a perspective view of still another modified example of the auxiliary plate of the planar inverted F antenna in accordance with the first exemplary embodiment of the present invention, and FIG. 8 is a side view of yet another modified example of the auxiliary plate of the planar inverted F antenna in accordance with the first exemplary embodiment of the present invention.

First, as shown in FIG. 6, in the planar inverted F antenna 100 in accordance with the first exemplary embodiment of the present invention, the auxiliary plate 150 may have the same width w as the antenna body 120.

In addition, as shown in FIG. 7, in the planar inverted F antenna 100 in accordance with the first exemplary embodiment of the present invention, the auxiliary plate 150 may have a width w larger than that of the antenna body 120.

As shown in FIGS. 6 and 7, when the widths w of the auxiliary plate 150 and the antenna body 120 have various ratios, it is possible to more readily perform a tuning process depending on design conditions of the mobile communication terminals.

In addition, as shown in FIG. 8, an auxiliary plate 150' may have a "T" shape.

Figure 9:
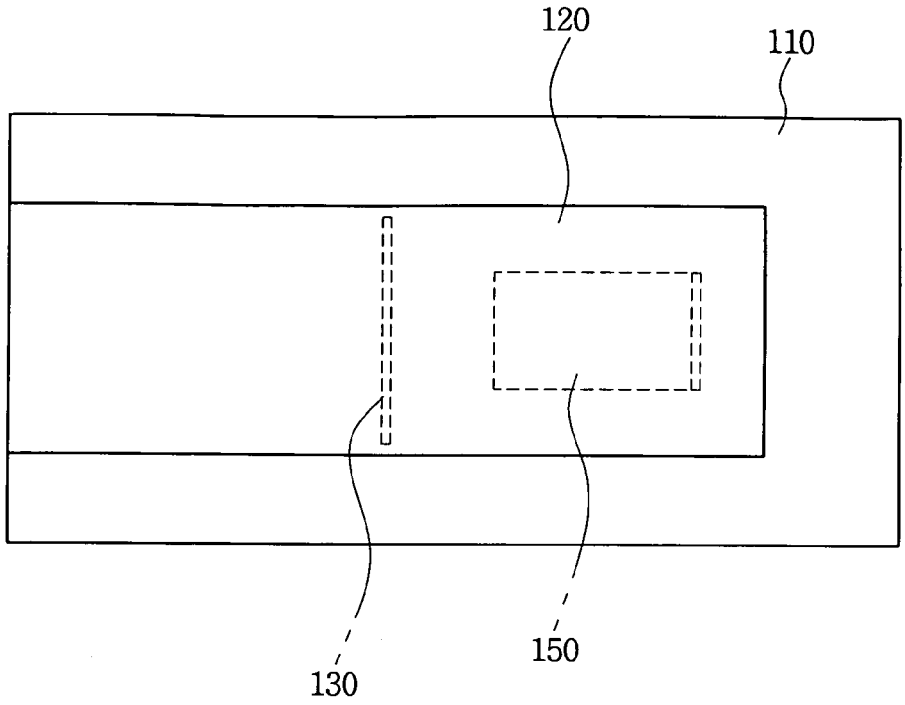
FIG. 9 is a top view of a modified example of a feed line of the planar inverted F antenna in accordance with the first exemplary embodiment of the present invention.

Further, as shown in FIG. 2, the feed line 130 may be located at a position corresponding to ⅓ of the antenna body 120, or as shown in FIG. 9, the feed line 130 may be located at a position corresponding to ½ of the antenna body 120.

Figure 10:
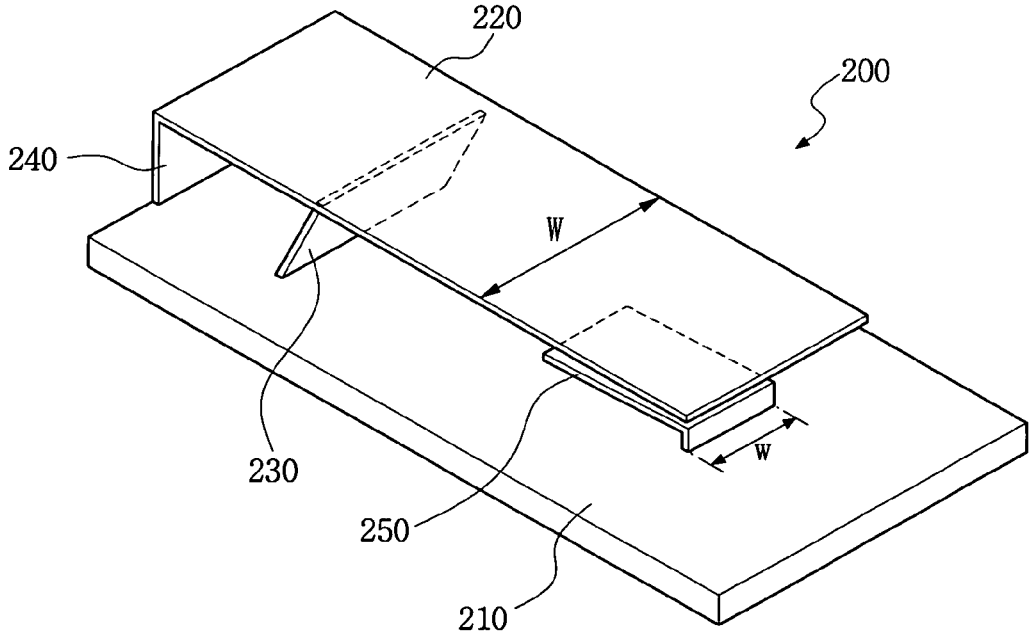
FIG. 10 is a perspective view of a planar inverted F antenna in accordance with a second exemplary embodiment of the present invention.
Figure 11:
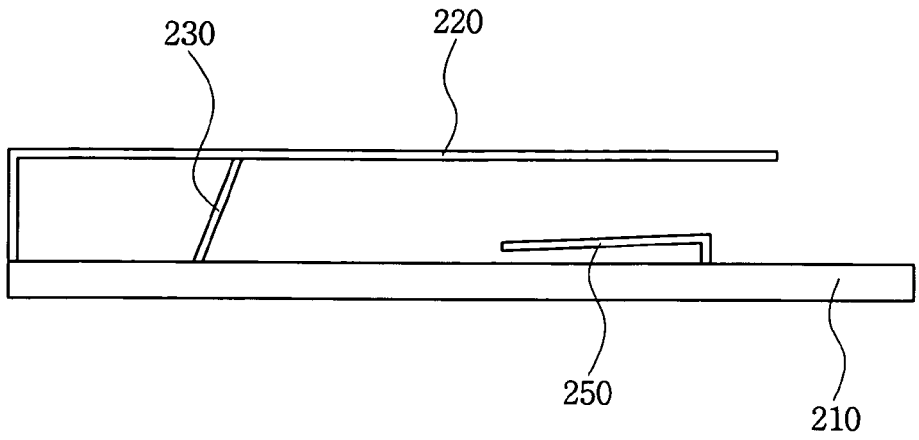
FIG. 11 is a side view of FIG. 10.
Figure 12:
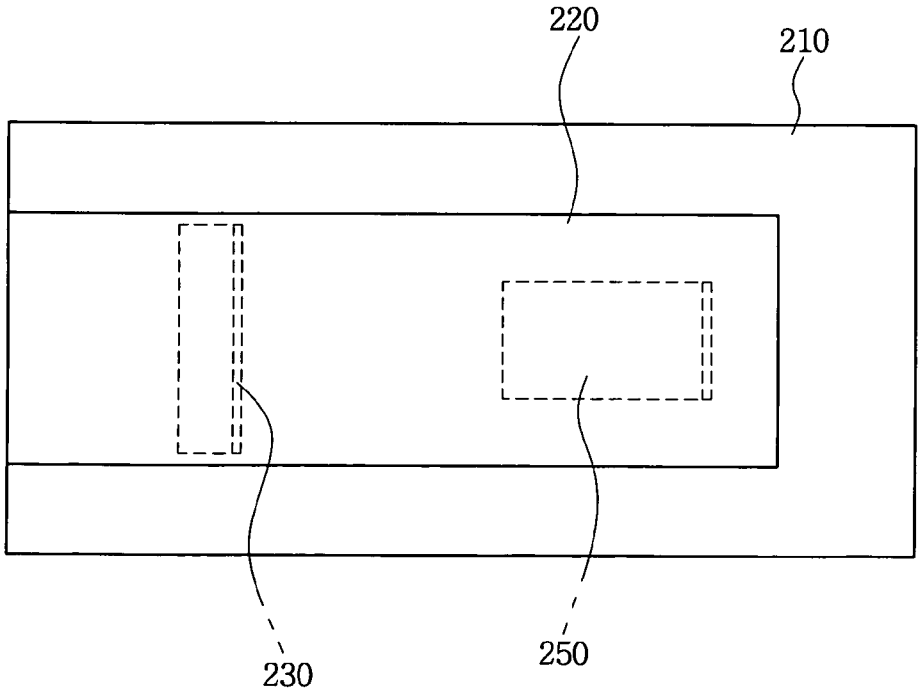
FIG. 12 is a top view of FIG. 10.

Meanwhile, FIG. 10 is a perspective view of a planar inverted F antenna in accordance with a second exemplary embodiment of the present invention, FIG. 11 is a side view of FIG. 10, and FIG. 12 is a plan view of FIG. 10.

Referring to FIGS. 10 to 12, a planar inverted F antenna 200 in accordance with the second exemplary embodiment of the present invention includes a ground surface 210 having a finite plane and formed of a conductive material.

Here, conventionally, the ground surface 210 is a printed circuit board. An antenna body 220 is horizontally installed over the ground surface 210 at a certain distance from the ground surface 210 and transmits/receives radio waves.

A feed line 230 is installed on the ground surface 210 in an inclined manner to electrically connect the antenna body 220 to the ground surface 210.

A ground pin 240 is formed at an end of the antenna body 220 to ground the antenna body 220 to the ground surface 210.

An auxiliary plate 250 is installed between the antenna body 220 and the ground surface 210 in an inclined manner.

The auxiliary plate 250 may have a width w relatively smaller than that of the antenna body 220.

Hereinafter, operation of the planar inverted F antenna in accordance with the second exemplary embodiment of the present invention will be described.

The planar inverted F antenna 200 in accordance with the second exemplary embodiment of the present invention can remarkably reduce the total size of the antenna at the same frequency by installing the inclined auxiliary plate 250 between the ground surface 210 and the antenna body 220, in consideration of the above problems.

Therefore, in keeping with the slimming and miniaturization of mobile communication terminals, it is possible to design a smaller antenna.

Figure 13:
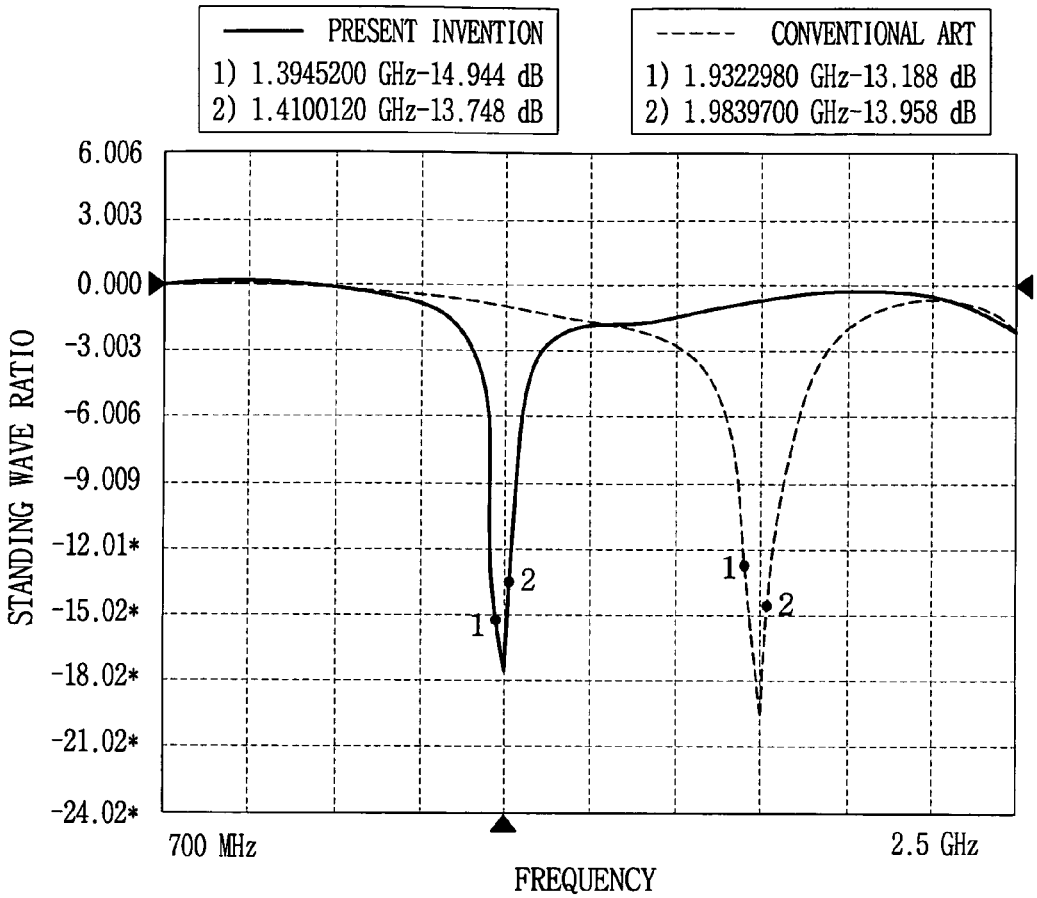
FIG. 13 is a graph showing the performance of the planar inverted F antenna in accordance with the second exemplary embodiment of the present invention.

FIG. 13 is a graph for comparing the performance of a conventional planar inverted F antenna with the performance of the planar inverted F antenna in accordance with the second exemplary embodiment of the present invention.

In the graph of FIG. 13, the X-axis represents frequency, and the Y-axis represents standing wave ratio. A solid line represents an experiment value of the present invention, and a broken line represents an experiment value of the conventional art.

As a result of measuring frequencies of arbitrary points around a standing wave ratio of −15 dB to −12 dB, the frequencies of the conventional art are 1.9322 GHz and 1.9839 GHz, respectively, and the frequencies of the present invention are 1.3945 GHz and 1.4100 GHz, respectively.

Comparing the present invention with the conventional art in this graph, it will be appreciated that the frequency of the present invention is reduced by about 0.5 to 0.6 GHz.

Considering the inverse relationship between frequency and antenna size, it will be appreciated that the total size of the antenna can be remarkably reduced when the same frequency is used, and the second exemplary embodiment has a better effect than that of the first exemplary embodiment.

Figure 14:
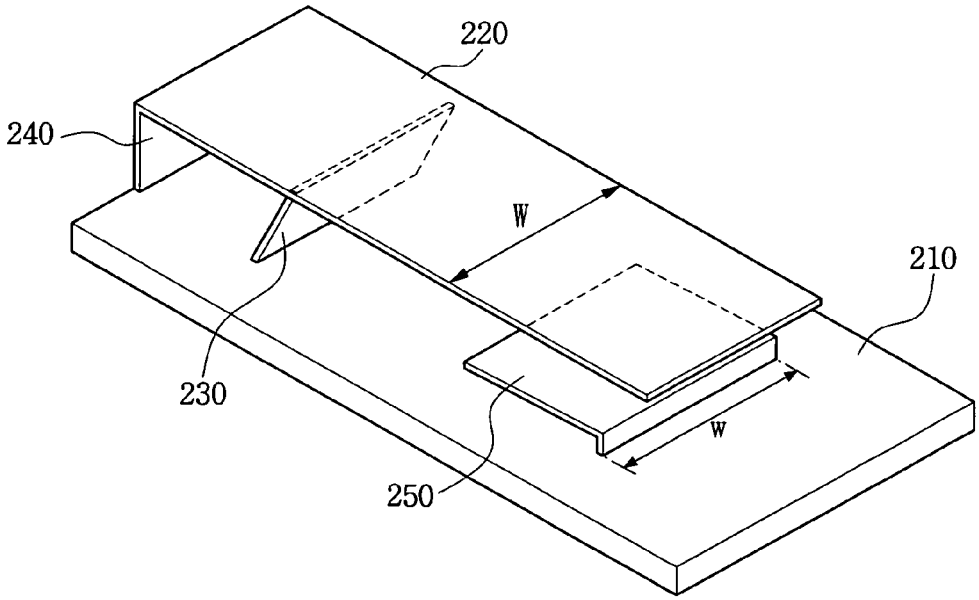
FIG. 14 is a perspective view of a modified example of an auxiliary plate of the planar inverted F antenna in accordance with the second exemplary embodiment of the present invention.
Figure 15:
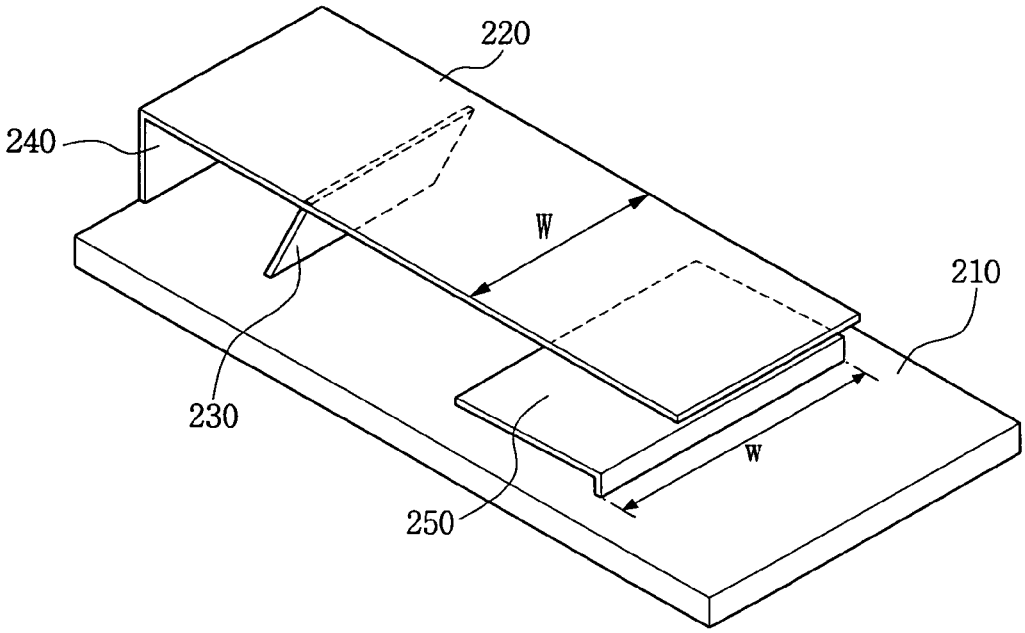
FIG. 15 is a perspective view of another modified example of the auxiliary plate of the planar inverted F antenna in accordance with the second exemplary embodiment of the present invention.
Figure 16:
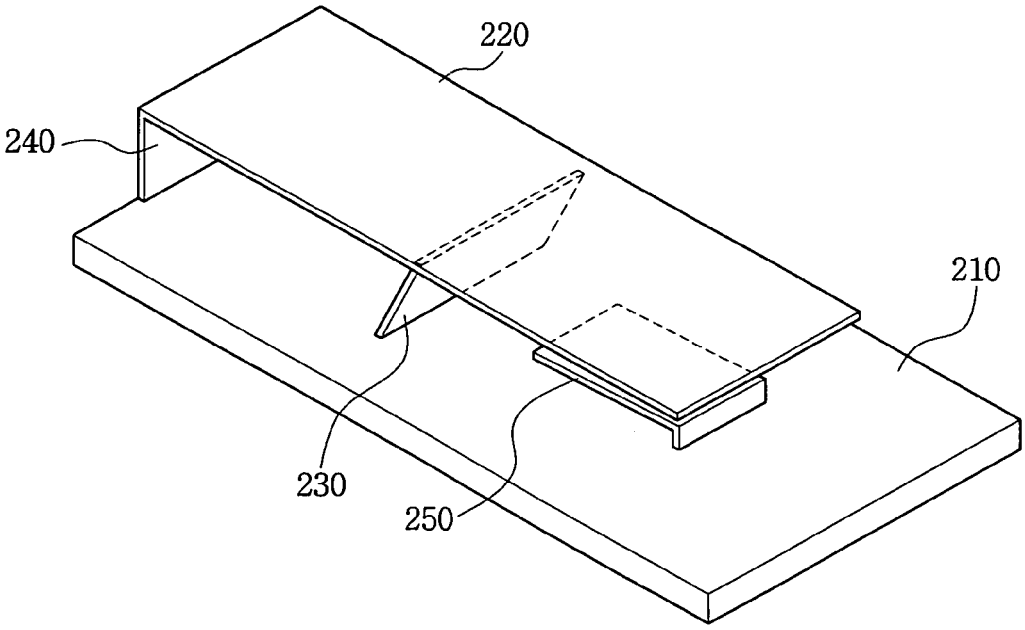
FIG. 16 is a perspective view of a modified example of a feed line of the planar inverted F antenna in accordance with the second exemplary embodiment of the present invention.

FIG. 14 is a perspective view of a modified example of an auxiliary plate of the planar inverted F antenna in accordance with the second exemplary embodiment of the present invention, FIG. 15 is a perspective view of another modified example of the auxiliary plate of the planar inverted F antenna in accordance with the second exemplary embodiment of the present invention, and FIG. 16 is a perspective view of a modified example of a feed line of the planar inverted F antenna in accordance with the second exemplary embodiment of the present invention.

First, as shown in FIG. 14, in the planar inverted F antenna 200 in accordance with the second exemplary embodiment of the present invention, the auxiliary plate 250 may have the same width w as the antenna body 220.

In addition, as shown in FIG. 15, in the planar inverted F antenna 200 in accordance with the second exemplary embodiment of the present invention, the auxiliary plate 250 may have a width w larger than that of the antenna body 220.

Further, as shown in FIG. 12, the feed line 230 may be located at a position corresponding to ⅓ of the antenna body 220, or as shown in FIG. 16, the feed line 230 may be located at a position corresponding to ½ of the antenna body 220.

Figure 17:
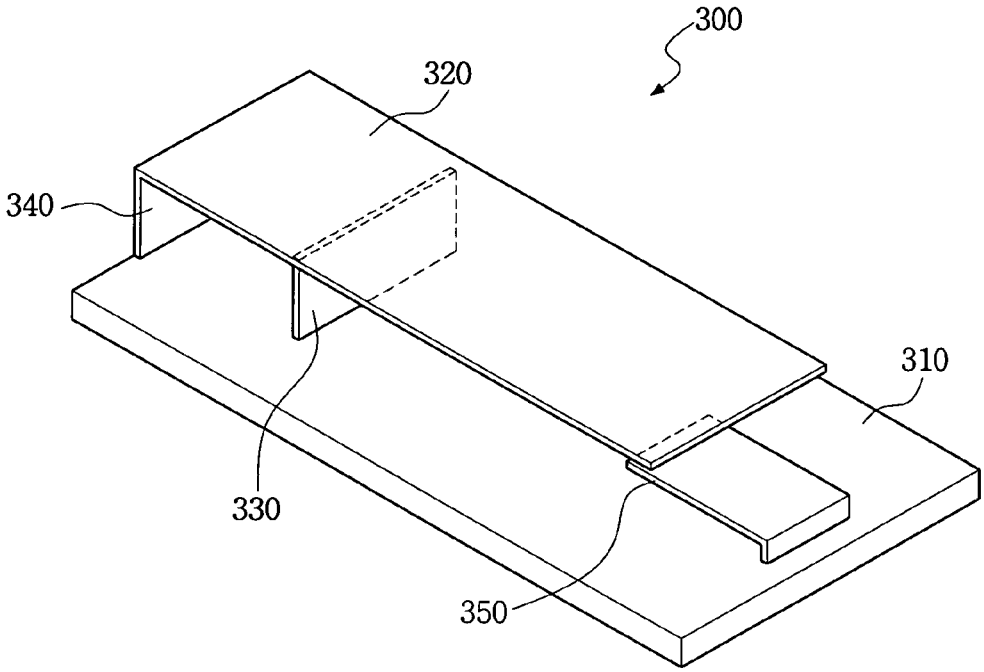
FIG. 17 is a perspective view of a planar inverted F antenna in accordance with a third exemplary embodiment of the present invention.
Figure 18:
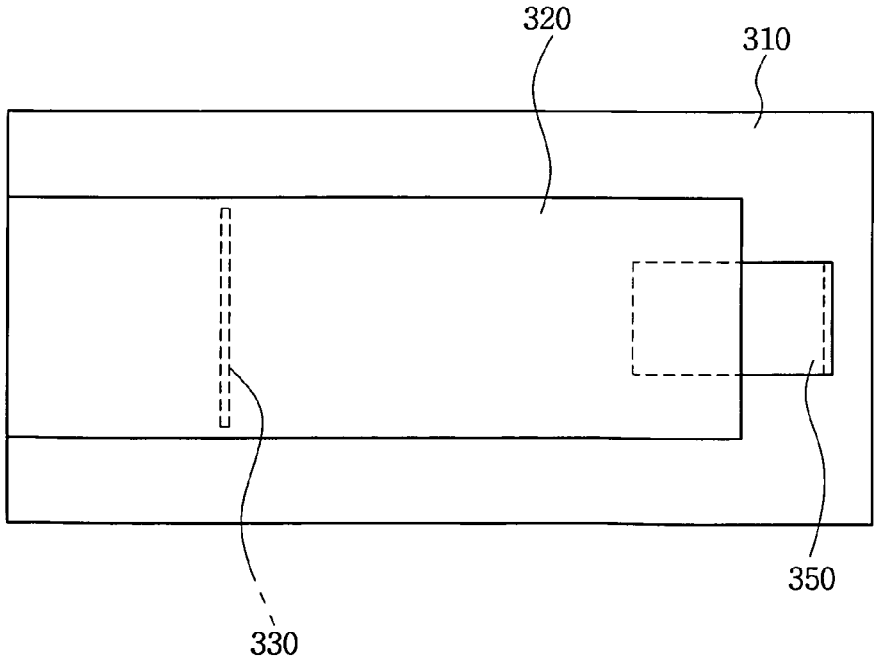
FIG. 18 is a top view of FIG. 17.
Figure 19:
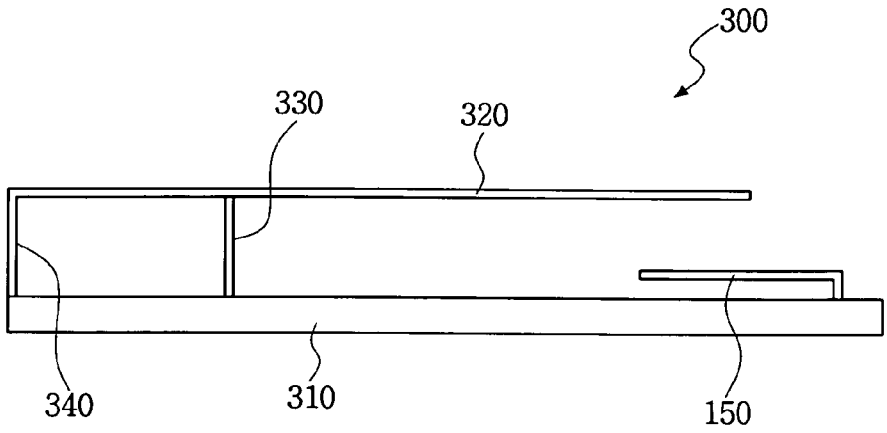
FIG. 19 is a side view of FIG. 17.

FIG. 17 is a perspective view of a planar inverted F antenna in accordance with a third exemplary embodiment of the present invention, FIG. 18 is a top view of FIG. 17, and FIG. 19 is a side view of FIG. 17.

Referring to FIGS. 17 to 19, a planar inverted F antenna 300 in accordance with the third exemplary embodiment of the present invention includes a ground surface 310 having a finite plane and formed of a conductive material.

Here, conventionally, the ground surface 310 is a printed circuit board. An antenna body 320 is horizontally installed over the ground surface 310 at a certain distance from the ground surface 310 and transmits/receives radio waves.

A feed line 330 is vertically installed on the ground surface 310 to electrically connect the antenna body 320 to the ground surface 310.

A ground pin 340 is formed at an end of the antenna body 320 to ground the antenna body 320 to the ground surface 310.

An auxiliary plate 350 is installed between the antenna body 320 and the ground surface 310.

A portion of the auxiliary plate 350 is covered by the antenna body 320, and the other portion of the auxiliary plate 350 is exposed.

The auxiliary plate 350 may have a width w relatively smaller than that of the antenna body 320.

Hereinafter, operation of the planar inverted F antenna in accordance with the third exemplary embodiment of the present invention will be described.

The planar inverted F antenna 300 in accordance with the third exemplary embodiment of the present invention can remarkably reduce the total size of the antenna at the same frequency by installing the auxiliary plate 350 between the ground surface 310 and the antenna body 320 in consideration of the above problems.

Therefore, in keeping with the slimming and miniaturization of mobile communication terminals, it is possible to design a smaller antenna.

Figure 20:
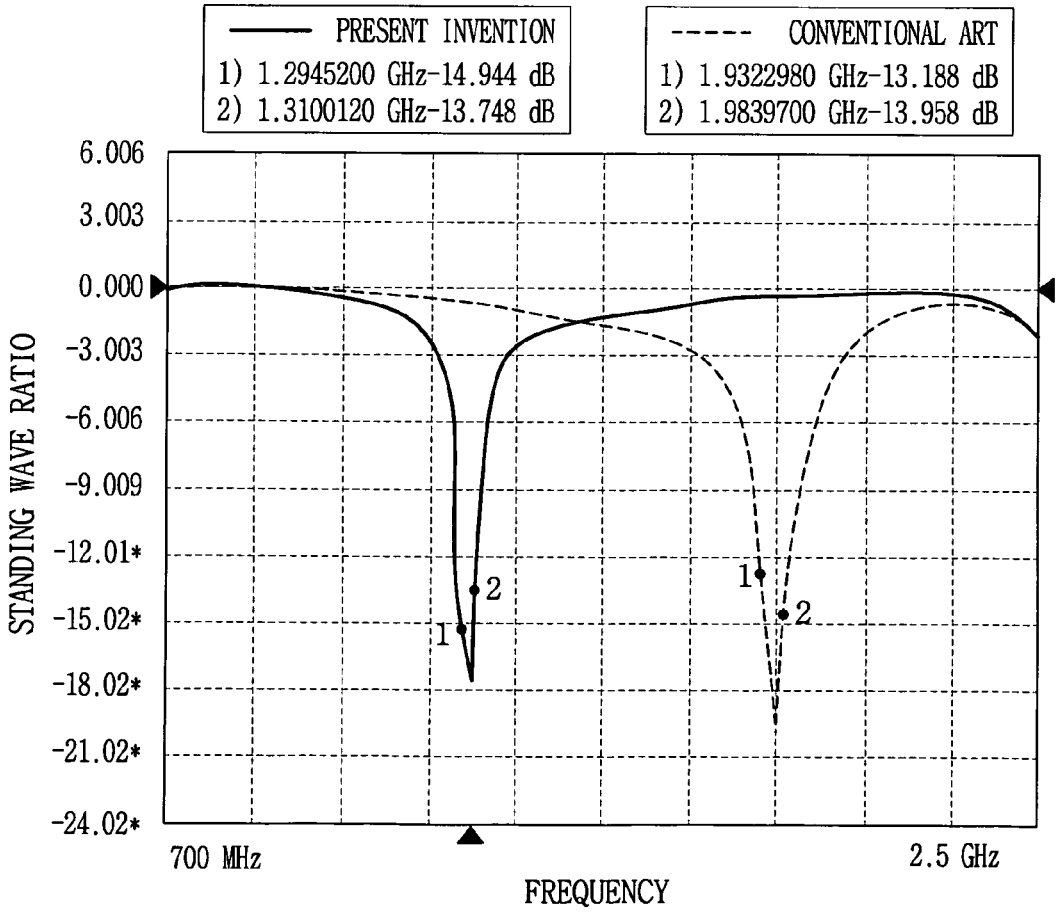
FIG. 20 is a graph showing the performance of the planar inverted F antenna in accordance with the third exemplary embodiment of the present invention.

FIG. 20 is a graph for comparing the performance of a conventional planar inverted F antenna with the performance of the planar inverted F antenna in accordance with a third exemplary embodiment of the present invention.

In the graph of FIG. 20, the X-axis represents frequency, and the Y-axis represents standing wave ratio. A solid line represents an experiment value of the present invention, and a broken line represents an experiment value of the conventional art.

As a result of measuring frequencies of arbitrary points around a standing wave ratio of −15 dB to −12 dB, the frequencies of the conventional art are 1.9322 GHz and 1.9839 GHz, respectively, and the frequencies of the present invention are 1.2945 GHz and 1.3100 GHz, respectively.

Comparing the present invention with the conventional art in this graph, it will be appreciated that the frequency of the present invention is reduced by about 0.6 to 0.7 GHz.

Considering the inverse relationship between frequency and antenna size, it will be appreciated that the total size of the antenna can be remarkably reduced when the same frequency is used, and the third exemplary embodiment has a better effect than that of the first exemplary embodiment.

As can be seen from the foregoing, a planar inverted F antenna in accordance with the present invention can reduce the size of the antenna and readily tune the antenna in keeping with the slimming and miniaturization of mobile communication terminals by installing an auxiliary plate between a ground surface and an antenna body.

Accordingly, in keeping with the slimming and miniaturization of the mobile communication terminals, it is possible to remarkably reduce the size of the antenna at the same frequency.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A planar inverted F antenna comprising:

a planar ground surface formed of a conductive material;

an antenna body disposed at a first distance from the ground surface and configured to transmit and receive radio waves, the antenna body having a length longer than a width;

a planar feed line configured to electrically connect the ground surface and the antenna body;

a ground pin disposed at a first end of the antenna body length, the ground pin configured to ground the antenna body to the ground surface; and at least one auxiliary plate disposed between the antenna body and the ground surface, wherein the at least one auxiliary plate comprises (i) a support portion connected to and projecting away from the ground surface, the support portion disposed away from the first end of the antenna body length and proximate to a second end of the antenna body length, and (ii) a planar portion connected to and projecting away from the support portion and toward the feed line, the planar portion being substantially parallel to the ground surface.

2. The planar inverted F antenna according to claim 1, wherein the auxiliary plate has a width relatively smaller than that of the antenna body.

3. The planar inverted F antenna according to claim 1, wherein the auxiliary plate has a "T" shape.

4. The planar inverted F antenna according to claim 1, wherein the auxiliary plate has a width equal to that of the antenna body.

5. The planar inverted F antenna according to claim 1, wherein the auxiliary plate has a width relatively larger than that of the antenna body.

6. The planar inverted F antenna according to claim 1, wherein the ground surface comprises a printed circuit board.

7. The planar inverted F antenna according to claim 1, wherein the feed line is located at a position corresponding to ⅓ of the antenna body length.

8. The planar inverted F antenna according to claim 1, wherein the feed line is located at a position corresponding to ½ of the antenna body length.

9. A planar inverted F antenna comprising:

a planar ground surface formed of a conductive material;

an antenna body disposed at a first distance from the ground surface and configured to transmit and receive radio waves, the antenna body having a length longer than a width;

a planar feed line configured to electrically connect the ground surface and the antenna body;

a ground pin disposed at a first end of the antenna body length, the ground pin configured to ground the antenna body to the ground surface; and at least one auxiliary plate disposed between the antenna body and the ground surface, wherein the at least one auxiliary plate comprises (i) a support portion connected to and projecting away from the ground surface, the support portion disposed away from the first end of the antenna body length and proximate to a second end of the antenna body length, and (ii) a planar portion connected to and projecting away from the support portion and toward the feed line, the planar portion disposed at an incline relative to the ground surface and the antenna body.

10. The planar inverted F antenna according to claim 9, wherein the feed line is connected to the ground surface at an incline relative to the ground surface.

11. The planar inverted F antenna according to claim 9, wherein the auxiliary plate has a width relatively smaller than that of the antenna body.

12. The planar inverted F antenna according to claim 9, wherein the auxiliary plate has a width equal to that of the antenna body.

13. The planar inverted F antenna according to claim 9, wherein the auxiliary plate has a width relatively larger than that of the antenna body.

14. The planar inverted F antenna according to claim 9, wherein the ground surface comprises a printed circuit board.

15. The planar inverted F antenna according to claim 9, wherein the feed line is located at a position corresponding to ⅓ of the antenna body length.

16. The planar inverted F antenna according to claim 9, wherein the feed line is located at a position corresponding to ½ of the antenna body length.

17. A planar inverted F antenna comprising:

a planar ground surface formed of a conductive material;

an antenna body disposed at a first distance from the ground surface and configured to transmit and receive radio waves, the antenna body having a length longer than a width;

a planar feed line configured to electrically connect the ground surface and the antenna body;

a ground pin disposed at a first end of the antenna body length, the ground pin configured to ground the antenna body to the ground surface; and at least one auxiliary plate disposed between the antenna body and the ground surface, wherein the at least one auxiliary plate comprises (i) a support portion connected to and projecting away from the ground surface, the support portion disposed away from the first end of the antenna body length and proximate to a second end of the antenna body length, and (ii) a planar portion connected to and projecting away from the support portion and toward the feed line, the planar portion being substantially parallel to the ground surface, wherein a first portion of the planar portion is covered by the antenna body and a second portion of the planar portion is not covered by the antenna body.

18. The planar inverted F antenna according to claim 17, wherein the auxiliary plate has a width relatively smaller than, equal to, or relatively larger than that of the antenna body.

19. The planar inverted F antenna according to claim 17, wherein the feed line is located at a position corresponding to ⅓ of the antenna body length.

20. The planar inverted F antenna according to claim 17, wherein the feed line is located at a position corresponding to ½ of the antenna body length.

* * * * *